US005621307A

United States Patent [19]

Beggs

[11] Patent Number: 5,621,307

[45] Date of Patent: Apr. 15, 1997

[54] FAST RECOVERY TEMPERATURE COMPENSATED REFERENCE SOURCE

[75] Inventor: Kristin M. Beggs, Oviedo, Fla.

[73] Assignee: Harris Corporation, Melbourne, Fla.

[21] Appl. No.: 505,671

[22] Filed: Jul. 21, 1995

[51] Int. Cl.[6] ..... G05F 3/16

[52] U.S. Cl. ..... 323/313; 323/907; 327/538

[58] Field of Search ..... 363/313, 312, 363/314, 315, 316, 317, 907; 327/530, 538

[56] References Cited

U.S. PATENT DOCUMENTS

| | | | |
|---|---|---|---|
| 4,634,959 | 1/1987 | Boeckmann | 323/313 |
| 4,792,748 | 12/1988 | Thomas et al. | 323/312 |
| 5,029,295 | 7/1991 | Bennett et al. | 323/313 |
| 5,300,877 | 4/1994 | Tesch | 323/313 |

*Primary Examiner*—Peter S. Wong
*Assistant Examiner*—Adolf Berhane
*Attorney, Agent, or Firm*—Nixon, Hargrave, Devans & Doyle

[57] ABSTRACT

A precision voltage reference temperature compensated circuit 10 uses forward biased Zener diodes D2, D4 to provide a negative temperature coefficient compensation circuit and reverse biased Zener diodes D5–D6 to provide a positive temperature coefficient compensation circuit. Use of only Zener diodes results in a circuit 10 with fast recovery to the expected output voltage from transient events such as power supply perturbations, output load switching and/or gamma radiation events. The reference output voltage $V_{out}$ temperature characteristic is finally established by trimming resistors R3, R4 that are coupled between the current source including transistor Q1 and a positive temperature coefficient compensation circuit of diodes D5–D7. The precision reference output voltage level is finally established by trimming the resistors R5 and R6 that are coupled between the output of the temperature coefficient trim network and ground.

24 Claims, 2 Drawing Sheets

FAST RECOVERY TEMPERATURE COMPENSATED REFERENCE SOURCE

BACKGROUND

This invention relates in general to precision reference sources and, in particular, to fast recovery temperature compensated precision voltage reference sources.

Many applications require precision voltage reference sources that exhibit fast recovery from transient events common to many system environments. It is important that these precision sources recover quickly from line perturbations, load switching and other events that can cause a transient deviation from normal operating conditions. It is often a requirement that signal processing circuits have a stable reference voltage circuit capable of providing an output voltage that remains relatively constant over a wide range of ambient operating conditions, including changes in temperature. Stable voltage sources are needed in power supply circuits and in personal computers where power to the precision supply or to the system blocks that load the supply is reduced or turned off. When it is desired to return to full power, the user wants to reach full system operation as soon as practically possible.

For this purpose, in the past, others have employed semiconductor voltage elements such as Zener diodes as a primary component of the voltage reference circuit. The Zener diode is typically operated in a reverse bias condition and voltage variations due to temperature are compensated with additional circuitry. One example of a precision voltage reference circuit is found in U.S. Pat. No. 5,300,877 assigned to the same assignee as this invention. In the referenced patent, a reverse biased Zener is coupled to a bridge resistor. The temperature variation in output voltage is compensated by two temperature compensation circuits, one circuit that provides a positive temperature coefficient compensation and another that provides negative temperature coefficient compensation. In both of the temperature compensation circuits, a reversed biased Zener diode is used as a reference source. The reverse biased Zener diode exhibits a positive temperature coefficient. That positive temperature coefficient is balanced by other devices exhibiting negative temperature coefficients.

As shown in particular in FIG. 4 and as discussed in column 6, line 7–16, two NPN transistors are coupled as transdiodes to provide temperature compensation for a series connected reverse biased Zener diode. The transdiodes have their bases shorted to their collectors and have a $V_{be}$ with a negative temperature coefficient. By selecting suitable operating points for these transdiodes and coupling them with a reverse biased Zener diode, the temperature coefficient of the circuit can be adjusted to have either a net positive or a net negative temperature coefficient. The reference also teaches how the output voltage of the circuit can be placed across a voltage divider with trimmable resistors and how the resistors can be trimmed at different temperatures in order to provide a relatively flat temperature coefficient over the operating range of the device.

However, devices such as those described in U.S. Pat. No. 5,300,877 have certain undesirable characteristics. The transdiode circuitry that makes up the negative temperature coefficient element may saturate when either the line voltage, $V_{cc}$, or the output loading varies sufficiently to cause transient current spikes through the reference element circuitry. Some environmental stresses, such as gamma radiation, can also cause these current spikes resulting in transdiode saturation and delayed recovery to normal operation.

Accordingly, it is desirable to have a precision temperature compensated voltage reference circuit that depends on elements which exhibit a fast recovery in the face of transient upset events such as line perturbations, load switching and gamma radiation.

SUMMARY

The invention provides a fast recovery temperature compensated reference circuit that has positive and negative temperature coefficient compensation circuits each of which are free from saturating elements such as transdiodes. In the reference circuit, the temperature compensation circuits include first and second diode networks. One diode network provides positive temperature compensation; the other diode network provides negative temperature coefficient compensation. A current source, typically a bipolar transistor, supplies a constant current to the first and second diode networks. A temperature trim resistor divider network is coupled between the current source and the connection between the first and second diode networks. A second divider network is coupled between the junction of the first divider and ground. The reference voltage output is taken from the junction of this second trim resistor network.

It is feature of the invention that the two diode networks do not include the same number of diodes and that the number of diodes in the two networks differ by one. The inventive circuit uses forward biased Zener diodes in one temperature compensation circuit and reversed biased Zener diodes in the other temperature compensation circuit. Because forward biased Zener diodes exhibit a temperature coefficient that is smaller in magnitude than that of reverse biased Zener diodes, the quantity of series connected forward diodes must be n+1, where n is the number of series connected reverse biased zeners. This arrangement ensures that the circuit can be trimmed for a flat temperature coefficient.

The inventive circuit has two pairs of trim resistors. The temperature trim pair is coupled from the collector of the transistor current source to the cathodes of the reference diodes. Since the temperature characteristics of the Zener diode in either the reverse or forward biased mode increases with increased operating current, trimming one resistor of the pair will increase the reference voltage output temperature coefficient and trimming the other resistor will decrease the reference voltage output temperature coefficient. The circuit is tested at two or more temperatures and the trim resistors are trimmed to give the circuit the desired temperature coefficient. The second trim resistor pair is a simple voltage divider used to adjust output voltage.

DETAILED DESCRIPTION

Figure 1:
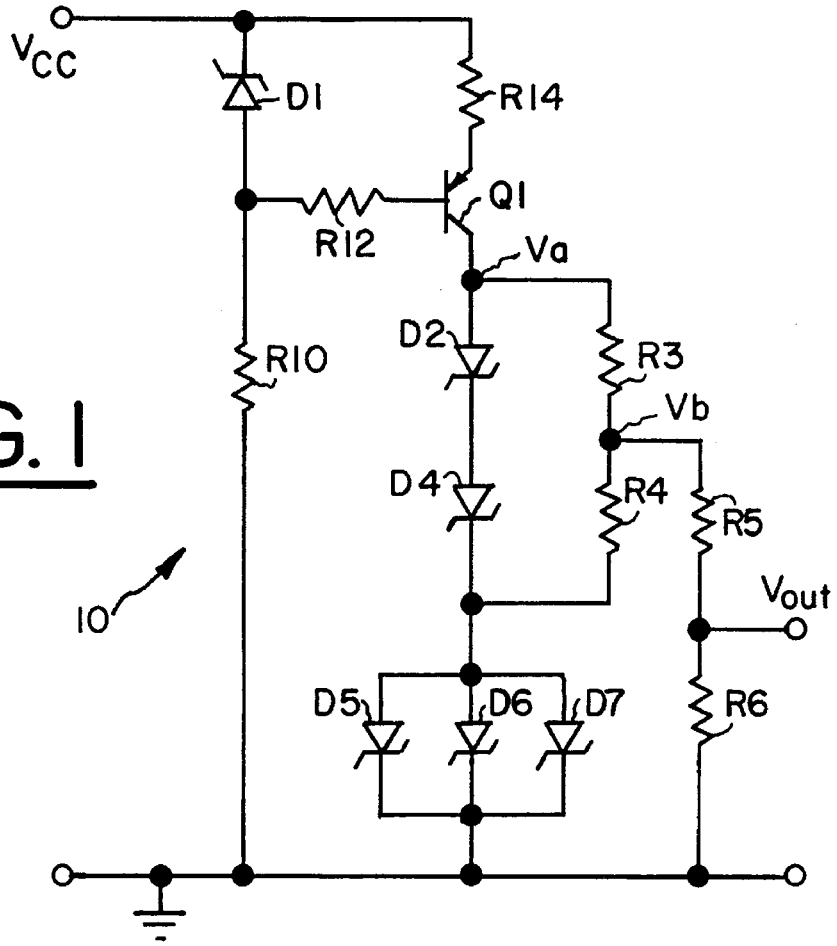
FIG. 1 is a circuit schematic diagram showing one embodiment of the invention.

With reference to FIG. 1, there is shown a temperature compensated precision reference voltage circuit 10. A supply voltage $V_{cc}$ applies a positive supply voltage to the circuit 10. The positive supply voltage is used to generate a stable current. The stable current is input into the diode stack comprising forward biased Zener diodes D2 and D4 and the three reverse biased Zener diodes D5, D6, and D7. Current into the diode stack is provided by a bias circuit including resistors R10, R12, and R14, Zener diode D1, and transistor Q1. Zener D1 is reversed biased. R10 has a value of about 12k, R12 is 1k, and R14 is 2k, thus providing a reference current of about 1 mA. Accordingly, the reverse biased Zener diode D1 together with R10 establishes the voltage at the base of transistor Q1. The positive temperature coefficient of D1 works with the negative temperature coefficient of Q1 $V_{BE}$ to provide a relatively constant Q1 emitter voltage and thus a constant reference current over temperature.

The negative temperature coefficient circuit is formed by series connected, forward biased diodes D2 and D4. Diodes D5, D6, and D7 provide the positive temperature coefficient circuit. Diodes D5, D6, and D7 are arranged in parallel with their cathodes coupled together and to the cathode of D4. The anodes of diodes D5, D6, and D7 are coupled to ground. A pair of trim resistors R3 and R4, are coupled across diodes D2 and D4 between the collector of Q1 and the junction of the cathode of diode D4 and the cathodes of diodes D5, D6, and D7. A second pair of trimmable resistors R5 and R6 are connected between the R3/R4 junction and ground. This second pair provides a voltage divider to generate the output reference voltage $V_{out}$.

In operation, a constant collector current flows from the output of the collector of Q1. The forward biased diodes D2 and D4 each exhibit a voltage drop of about 0.7 volts. The reverse biased diodes D5, D6, and D7 each have a voltage drop of about 5.4 volts. As such, the voltage at $V_a$ has the sum of the diode voltage drops which is equal to approximately 0.7 v+0.7 v+5.4 v or 6.8 volts. As one can see, by suitable trimming of the resistors R5 and R6 the output voltage $V_{out}$ can be set to a typical desired voltage such as 4.5 volts as will be described hereinafter.

The series resistance of a zener diode operating in the reverse mode can be substantial, affecting circuit performances. By placing Zener diodes D5, D6, and D7 in parallel the series resistance is reduced several hundred ohms providing the overall circuit with improved line and load rejection.

In the above circuit, the transistor Q1 provides line noise rejection and the resistor network around Q1 (R10, R12, R14) limits the maximum current to maintain the output voltage within a small offset from nominal when the circuit 10 is subjected to transient effects such as power supply variation, load switching and/or gamma radiation. More specifically, when $V_{CC}$ changes provide a current spike and the voltage at the collector of Q1 begins to rise, instead of allowing the collector voltage to rise above the base voltage and thereby place Q1 into saturation, the stack of Zener diodes quickly sinks the current due to the increase voltage at VCC and therefore prevents Q1 from going into saturation. It will also be appreciated that the voltage stack D2, D4, D5, D6, and D7 does not include any transdiodes, so the reference elements themselves will not saturate. Therefore, circuit 10 will be expected to regain its expected output voltage within a small period of time.

Temperature coefficient trim is generally performed at two specific operating temperatures, typically 30 degrees centigrade and 70 degrees centigrade. Temperature coefficient calculations at these two temperatures will determine which of the two temperature compensation trim resistors R3, R4 to trim. The forward bias diodes D2 and D4 have a negative temperature coefficient while the reverse biased diodes D5, D6, and D7 have a positive temperature coefficient. Trimming resistor R3 raises the temperature coefficient of the overall circuit and trimming resistor R4 lowers the net temperature coefficient of the circuit.

Those skilled in the art will appreciate that the number of series reverse biased Zener diodes D5, D6, and D7 is one less than the number of forward biased diodes D2 and D4. This differential in numbers of series connected diodes between the positive temperature compensation circuit and the negative temperature compensation circuit is intentional. By giving the circuit 10 an overall slightly negative temperature coefficient the voltage $V_{out}$ can be suitably trimmed to exhibit the desired voltage vs. temperature characteristic. More specifically, when R3 is trimmed its resistance is increased. The increase in resistance of R3 will increase the amount of current flowing into the reference stack D2–D7. Through algebraic analysis of circuit 10, it can be shown that this has a overall effect of making the circuit temperature coefficient more positive. Trimming R4 will lower the overall temperature compensation characteristic of the circuit. This results because trimming of resistor R4 will divert current away from the parallel diodes D5–D7. By reducing current to a circuit that has a positive temperature coefficient, the net effect is to reduce the overall temperature coefficient of the circuit. This result can also be confirmed by mathematical analysis.

Resistors R5 and R6 are typical voltage divider resistors. Trimming R5 will lower the output voltage and trimming R6 will raise the output voltage. In particular, circuit 10 is trimmed as follows:

From Kirchhoff's Current Law into node Vb:

$$\frac{Vb-Va}{R_3}+\frac{Vb-Vzr}{R_4}+\frac{Vb-Vo}{R_5}=0 \tag{1}$$

Voltages Va and Vo are described by:

$$Va = Vzr + 2Vzf \tag{2}$$

$$Vo = Vb\left(\frac{R_6}{R_5+R_6}\right) \tag{3}$$

The substitution of (3) and (2) into (1), solving for Vo gives:

$$Vo=\frac{R_6((R_3+R_4)Vzr+2R_4Vzf)}{R_4R_5+R_4R_6+R_3R_5+R_3R_6+R_3R_4} \tag{4}$$

Temperature Trim

Trim resistors R3 and R4 control the temperature coefficient characteristics of the FRTCPR by adjusting the operating points of forward and reverse biased reference elements of the circuit.

Taking the derivative of equation (4) with respect to temperature:

$$\frac{dVo}{dT}=\left(\frac{R_6}{R_4R_5+R_4R_6+R_3R_5+R_3R_6+R_3R_4}\right)\left((R_3+R_4)\frac{d}{dT}(Vzr)+2R_4\frac{d}{dT}(Vzf)\right) \tag{5}$$

Simplifying and solving for R3 yields:

$$R_3=\frac{R_4(R_6(2\Delta Vzf-\Delta Vzr-\Delta Vo)-R_5\Delta Vo)}{\Delta Vo(R_4+R_5+R_6)+R_6\Delta Vzr} \tag{6}$$

Where Vzr is −|Vzr| and therefore takes the negative sign. And for R4:

$$R_4 = \frac{R_3(R_6\Delta Vzr - \Delta Vo(R_5 + R_6))}{Vo(R_3 + R_5 + R_6) - R6(\Delta Vzr - 2\Delta Vzf)} \quad (7)$$

Since a Zener diode operating in forward mode has a negative temperature coefficient while a reverse biased Zener has a positive tempco, Equation (5) shows that trimming R3 will increase and trimming R4 will decrease the output voltage temperature coefficient. The output voltage is measured at two temperature extremes, from which the untrimmed temperature coefficient is calculated; then Equation (6) or (7) is used for untrimmed negative or positive tempco, respectively. In most cases, ΔVo is set to 0 unless the target temperature coefficient is non-zero (perhaps to compensate for known packaging drifts). Since only R3 or R4 is trimmed, all variables in equations (6) and (7) are known. (The pre-trim values of R5 and R6 are used; resistors are initially sized such that the $V_{out}$ trim is sufficiently decoupled from the tempco trim.)

Output Voltage Trim

R5 and R6 are the output voltage trim resistors. Being a tap off a simple voltage divider network, the output is increased in voltage by trimming R6 and decreased by trimming R5. Returning to Equation (4) and solving for R5:

$$R_5 = \frac{R_6Vzr(R_3 + R_4) + 2R_4R_6Vzf - Vo(R_4R_6 + R_3R_6 + R_3R_4)}{Vo(R_3 + R_4)} \quad (8)$$

And for R6:

$$R_6 = \frac{Vo(R_4R_5 + R_3R_5 + R_3R_4)}{Vzr(R_3 + R_4) + 2R_4Vzf - Vo(R_3 + R_4)} \quad (9)$$

For increased precision, the trim may be further adjusted in an iterative manner by incrementing either R5 or R6 and monitoring the output voltage.

Figure 2:
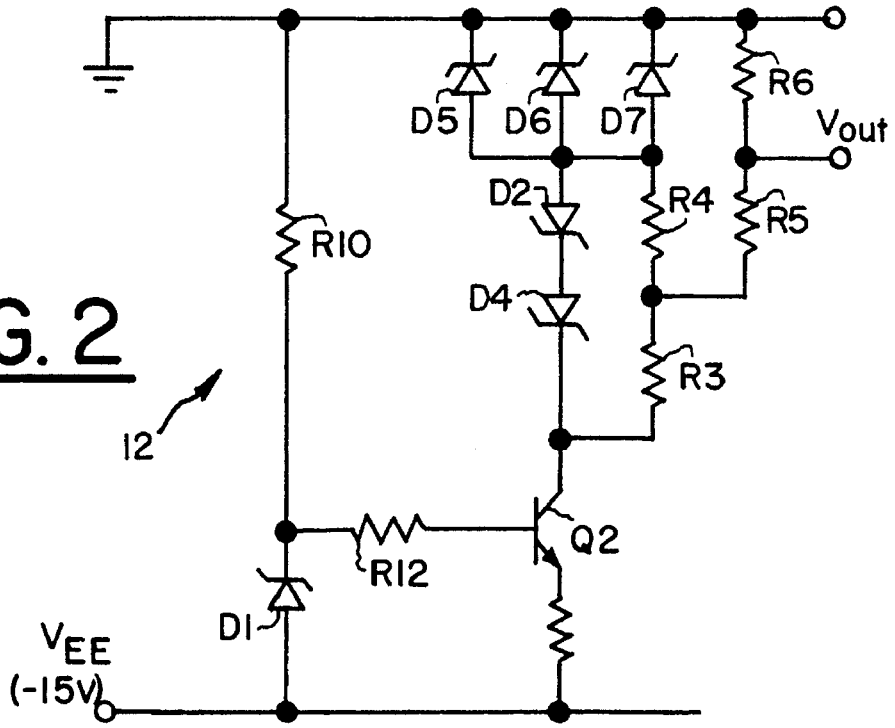
FIG. 2 is a schematic drawing showing the second embodiment of the invention.

Turning to FIG. 2, there is shown an alternate embodiment of the invention that provides a negative reference voltage. It will be seen that the three Zener diodes D5, D6, and D7 are still arranged in parallel, and are reversed biased and that the diodes D2, D4 are still in series and are forward biased. Thus, the anode of diode D2 is coupled to file anodes of D5–D7.

Figure 3:
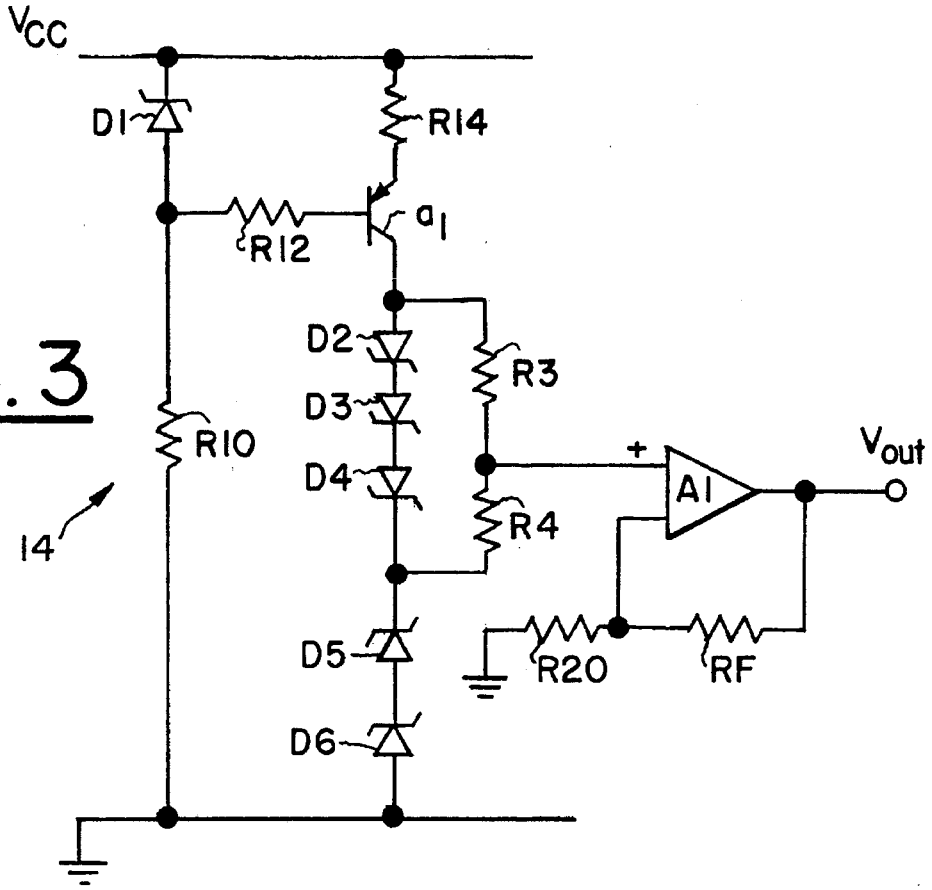
FIG. 3 is a schematic drawing showing the third embodiment of the invention.

Further modifications to the circuit 10 are shown in FIG. 3. There, circuit 14 has three forward biased diodes D2–D4 coupled in series to connected reversed biased diodes D5 and D6. This particular five diode stack arrangement provides a higher voltage drop so that $V_{out}$ can be adjusted to a higher output voltage than the previous embodiment allows. It will be noted that the forward diode drops across diodes D2–D4 provide about 0.7 volts each and that the series connected reversed biased diodes D5 and D6 provide about 5.4 volts each for a total voltage drop across the diode stack D2–D6 of approximately 12.9 volts. The trim resistors R3, R4 are trimmable in accordance with the procedures given above. A further circuit modification involves the addition of a buffering amplifier at the output of the temperature trim resistor network. This is the likely application of the precision reference in a system block. For this arrangement, a tap from the junction of resistors R3 and R4 is fed into an amplifier A1 that includes a feedback resistor network $R_f$ and a bias resistor $R_{20}$. This trimmable feedback resistor network provides a programmable closed loop gain for amplifier A1. As such, the user can select the suitable resistance values for $R_f$ and $R_{zo}$ or a suitable combination of resistances in order to provide a desired output. Thus, the reference output maybe anywhere from several volts to 12 volts. These feedback resistors functionally replace the straight divider shown in previous embodiments. Only a single pair of feedback resistors $R_f$ and $R_{zo}$ is shown, but those skilled in the art will appreciate that a ladder of programmable resistors may be employed using suitable techniques well known in the art. Note that in this application the fast-recovering voltage node is that voltage at the noninverting input to A1. The recovery of the overall system is limited by the recovery time of amplifier A1.

Figure 4:
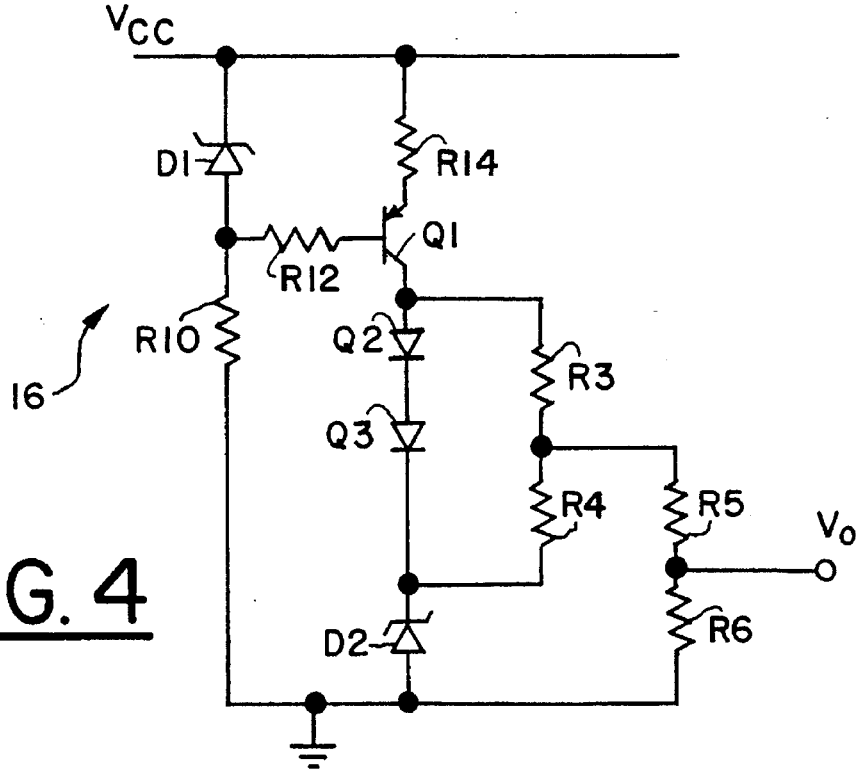
FIG. 4 is a circuit schematic diagram showing a fourth embodiment of the invention.

Still another embodiment of the invention is shown in FIG. 4. There, the circuit 16 employs two forward biased pn junction diodes Q2 and Q3. These pn junction diodes have a stable forward diode drop similar to a Zener diode and are the subject of a future patent. These diodes Q2 and Q3 do not saturate and thus may be substituted for the forward biased Zener diodes D2 and D4 as shown in FIG. 1. Circuit 16 provides a further advantage for radiation sensitive applications. It is know that forward voltage of Zener diodes may drift after being subjected to large dosages of radiation. Thus, by providing two pn junctions diodes Q2 and Q3, the voltage drift of the overall circuit is reduced.

Having thus described several embodiments of the invention, those skilled in the art will appreciate that further changes, modifications, alternations, additions, and deletions may be made to the disclosed embodiments without departing from the spirit and scope of the invention as set forth in the appended claims.

What I claim is:

1. A fast recovery temperature compensated reference circuit comprising:

a current source for supplying a constant supply of current;

a first diode network coupled in one series connection to the output of the current source, said first diode network comprising a first number of diodes and having a first temperature coefficient;

a second diode network coupled in another series connection to the first diode network, said second diode network comprising a second number of diodes and having a second temperature coefficient opposite to the first temperature coefficient; and a trim resistor divider network coupled at one end to the series connection of the first diode network to the current source and at its other end to the series connection of the first diode network to the second diode network.

2. The fast recovery temperature compensated reference circuit of claim 1 wherein the number of series connected diodes in each of the first and second diode networks is different.

3. The fast recovery temperature compensated reference circuit of claim 1 wherein the first diode network has a negative temperature coefficient and the second diode network has a positive temperature coefficient.

4. The fast recovery temperature compensated reference circuit of claim 1 wherein the first diode network comprises at least two diodes connected in series and the second diode network comprises at least three diodes connected in parallel.

5. The fast recovery temperature compensated reference circuit of claim 1 wherein the diodes are Zener diodes, the first diode network being forward biased and the second diode network being reverse biased.

6. The fast recovery temperature compensated reference circuit of claim 1 wherein the trim resistor divider network comprises a first and second trim resistors connected in series and providing an output voltage at said series connection, one trim resistor trimmable to raise the temperature coefficient of the output voltage of the reference circuit and the other trim resistor trimmable to lower the output voltage of the reference circuit.

7. The fast recovery temperature compensated reference circuit of claim 1 further comprising means coupled to the trim resistor divider network for adjusting the output of the circuit.

8. The fast recovery temperature compensated reference circuit of claim 7 wherein the means for adjusting the output of the circuit comprises a voltage divider of two or more trimmable resistors.

9. The fast recovery temperature compensated reference circuit of claim 8 wherein the means for adjusting the output of the circuit comprises an amplifier with a variable gain.

10. The fast recovery temperature compensated reference circuit of claim 1 wherein the number of diodes in the first diode network is different from the number of diodes in the second diode network.

11. The fast recovery temperature compensated reference circuit of claim 10 wherein one diode network has at least one more series connected diode than the other diode network.

12. The fast recovery temperature compensated reference circuit of claim 1 wherein one diode network comprises pn junction diodes and the other network comprises Zener diode(s).

13. The fast recovery temperature compensated reference circuit of claim 12 wherein the first diode network comprises at least two pn junction diodes forward biased and having a negative temperature coefficient and the second diode network comprises at least one Zener diode back biased and having a positive temperature coefficient.

14. The fast recovery temperature compensated reference circuit of claim 1 wherein the first diode network comprises a first number of diodes connected in series with each other and the second diode network comprises a second number of diodes connected in parallel with each other and the number of diodes in the first diode network is different from the number of diodes in the second diode network.

15. The fast recovery temperature compensated reference circuit of claim 14 wherein one diode network has at least one more series connected diode than the other diode network.

16. A fast recovery temperature compensated reference circuit comprising:

a current source comprising a reverse biased diode and a bipolar transistor having a base coupled to the anode of the diode for generating a constant collector current;

a first Zener diode network coupled to the collector of the transistor, said first Zener diode network comprising a first number of Zener diodes and having a first temperature coefficient;

a second Zener diode network coupled to the first Zener diode network, said second Zener diode network comprising a second number of Zener diodes and having a second temperature coefficient opposite to the first temperature coefficient; and a trim resistor divider network comprising first and second trim resistors connected in series to provide a voltage reference output at said connection of said two trim resistors, one trim resistor trimmable to raise the output voltage at the connection of the two resistors and the other resistor trimmable to lower the output voltage of at the connection of the two resistors.

17. The fast recovery temperature compensated reference circuit of claim 16 wherein the first Zener diode network comprises at least two Zener diodes connected in series to the collector of the transistor.

18. The fast recovery temperature compensated reference circuit 16 wherein the number of series connected diodes in the second Zener diode network is at least one more than the number of series connected Zener diodes in the first Zener diode network.

19. The fast recovery temperature compensated reference circuit 18 wherein the second Zener diodes network has a plurality of diodes connected in parallel.

20. The fast recovery temperature compensated reference circuit 18 wherein the second Zener diodes network has a plurality of diodes connected in series.

21. A method for providing a precision reference voltage comprising the steps of:

supplying a current from a bipolar current source;

conditioning the supply current with a non-saturating positive temperature coefficient current;

conditioning the supply current with a non-saturating negative temperature coefficient current;

coupling the conditioned current to a voltage divider with trimmable resistors connected in series with each other in order to provide an output voltage temperature characteristic to the conditioned current;

trimming one resistor to increase the effect of the negative coefficient current conditioning;

trimming the other resistor to increase the effect of the positive temperature coefficient current conditioning.

coupling the conditioned current to a second voltage divider with trimmable resistors connected in series with each other in order to provide an output voltage from the conditioned current.

22. The method of claim 21 comprising the conditioning steps comprise connecting the supply current in series with the a forward biased Zener diode network to condition the supply current with a negative temperature coefficient current and with a reverse biased Zener diode network to condition the supply current with a positive temperature coefficient current.

23. The method of claim 21 further comprising the step of trimming one resistor to increase the overall output voltage.

24. The method of claim 23 further comprising the step of trimming the other resistor to decrease the overall output voltage.

* * * * *